US011712697B2

(12) United States Patent
Driver et al.

(10) Patent No.: US 11,712,697 B2
(45) Date of Patent: Aug. 1, 2023

(54) MICROTITER PLATES DESIGNED FOR HIGH-THROUGHPUT SCREENING OF PIERCING-SUCKING PESTS SUCH AS ARTHROPODS

(71) Applicant: BASF Agricultural Solutions Seed US LLC, Florham Park, NJ (US)

(72) Inventors: Marion Ellis Driver, Morrisville, NC (US); Justin Jeong Dailey, St. Louis, MO (US)

(73) Assignee: BASF Agricultural Solutions Seed US LLC, Florham Park, NJ (US)

( * ) Notice: Subject to any disclaimer, the term of this patent is extended or adjusted under 35 U.S.C. 154(b) by 76 days.

(21) Appl. No.: 16/762,244

(22) PCT Filed: Nov. 20, 2018

(86) PCT No.: PCT/US2018/061908
§ 371 (c)(1),
(2) Date: May 7, 2020

(87) PCT Pub. No.: WO2019/103986
PCT Pub. Date: May 31, 2019

(65) Prior Publication Data

US 2021/0001331 A1 Jan. 7, 2021

Related U.S. Application Data

(60) Provisional application No. 62/590,860, filed on Nov. 27, 2017.

(51) Int. Cl.
*B01L 3/00* (2006.01)

(52) U.S. Cl.
CPC ..... *B01L 3/50853* (2013.01); *B01L 2200/025* (2013.01); *B01L 2200/026* (2013.01);
(Continued)

(58) Field of Classification Search
CPC ..... A01M 1/103; A01M 5/00; A01M 5/02; A01M 2200/01; B01L 3/50853;
(Continued)

(56) References Cited

U.S. PATENT DOCUMENTS 5,945,271 A 8/1999 Cohen
6,485,690 B1 * 11/2002 Pfost ..... B01J 19/0046 422/552
(Continued)

FOREIGN PATENT DOCUMENTS

EP 1333286 A1 8/2003
EP 2597161 A2 5/2013
(Continued)

OTHER PUBLICATIONS

PCT International Search Report for PCT/US2018/061908, dated Jan. 29, 2019.
(Continued)

*Primary Examiner* — Jill A Warden
*Assistant Examiner* — Dwayne K Handy
(74) *Attorney, Agent, or Firm* — Barbara Campbell

(57) ABSTRACT

A multi-well microtiter plate is provided designed for high-throughput screening of piercing-sucking arthropods,such as insects exposed to various compounds. The microtiter plates comprise a base comprising a plurality of sample wells, a covering made from pierceable material, a housing unit comprising a plurality of housing wells providing a predetermined fit in the plurality of sample wells, and an air-penetrable seal. Methods for containing, screening, and/or imaging piercing-sucking pests andarthropods utilizing the multi-chambered microtiter plates are also provided.

4 Claims, 11 Drawing Sheets

(52) U.S. Cl.
CPC ... *B01L 2300/044* (2013.01); *B01L 2300/047* (2013.01); *B01L 2300/0829* (2013.01); *B01L 2300/0851* (2013.01); *B01L 2300/123* (2013.01)

(58) Field of Classification Search
CPC ..... B01L 2300/044; B01L 2300/0829; B01L 2300/0851
See application file for complete search history.

(56) References Cited

U.S. PATENT DOCUMENTS

| | | | | |
|---|---|---|---|---|
| 2004/0197235 | A1* | 10/2004 | Sorensen | B01L 3/50255 436/60 |
| 2013/0174473 | A1* | 7/2013 | Cink | A01M 1/026 43/131 |
| 2014/0322806 | A1 | 10/2014 | Bennett et al. | |
| 2015/0223442 | A1* | 8/2015 | Yamauchi | A01M 1/103 43/121 |

FOREIGN PATENT DOCUMENTS

| | | | |
|---|---|---|---|
| WO | 2007/027776 | A2 | 3/2007 |
| WO | 2008129300 | A1 | 10/2008 |

OTHER PUBLICATIONS

Epsky, Nancy D. "Feeding bioassay for stored-product insect pests using an encapsulated food source." Journal of Stored Products Research, (2002), vol. 38, No. 4: 319-327.

Habibi, et al., "Uptake, Flow, and Digestion of Casein and Green Fluorescent Protein in the Digestive System of Lygus hesperus Knight," Archives of Insect Biochemistry and Physiology, 2002, vol. 50, pp. 62-74.

Extended European Search Report dated Jul. 14, 2021 in European Application No. 18880731.7.

* cited by examiner

MICROTITER PLATES DESIGNED FOR HIGH-THROUGHPUT SCREENING OF PIERCING-SUCKING PESTS SUCH AS ARTHROPODS

CROSS-REFERENCE TO RELATED APPLICATIONS

This application is the National Stage entry of International Application No. PCT/US18/61908, filed 20 Nov. 2018, which claims priority to U.S. Provisional Application No. 62/590,860, filed 27 Nov. 2017.

BACKGROUND

1. Field

The present application claims priority to U.S. provisional application 62/590,860 filed Nov. 27, 2017. The provisional application is incorporated by reference in its entirety. The present disclosure relates to multi-chamber microtiter plates designed for high-throughput screening of pests, such as arthropods, exposed to various compounds. The present disclosure also relates to high-throughput methods of screening compounds for insecticidal activity.

2. Description of Related Art

Currently available liquid-feeding assays for piercing-sucking insects and arthropods are very manually-intensive and low-throughput because they have been reliant on hand-made Parafilm® sachets or vessels adapted from other uses.

For example, WO 2007/027776 describes a feeding assay designed for the Hemipteran piercing-sucking pest species, Lygus hesperus (Western Tarnished Plant Bug; WTPB). The feeding assay described therein is based on a 96 well microtiter plate format using a sachet system as described by Habibi et al., (Archives of Insect Biochem. and Phys. 50:62-74 (2002)). To construct the sachet, a sheet of Parafilm® was placed over a vacuum manifold designed for 96-well format and a vacuum of approximately −20 mm Hg was applied, causing extrusion of the Parafilm® into the wells. Forty μL of artificial diet+/−toxin were then added to the Parafilm® wells. A sheet of Mylar film was then placed over the Parafilm® and sealed with a tacking iron. The resulting Parafilm® sachets were then placed over a flat-bottom 96-well plate containing WTPB eggs suspended in agarose. After hatching, the WTPB nymphs feed by piercing the sachet that is presented above them.

A mass-produced microtiter plate for containing, screening, and/or imaging sucking piercing pests such as arthropods is not currently available, thus limiting the number of assays that can performed. Furthermore, current methods require time-consuming manual assembly of the bioassay microplates. Thus, microplates that can be assembled by automated means are needed to increase throughput.

The solution to this technical problem is provided by the embodiments characterized in the claims.

BRIEF SUMMARY

The present application relates to multi-chamber microtiter plates designed for high-throughput screening of piercing-sucking insects or arthropods. The base of the multi-chamber microtiter plate contains a plurality of wells with translucent bottoms to allow imaging. The base is covered by a covering that is pierceable by a piercing-sucking pest or arthropod's feeding anatomy. The top layer of the multi-chamber microtiter plate overlays the base and is designed for housing the piercing-sucking insects or arthropods. The top layer is covered by a perforated seal.

A multi-chambered microtiter plate comprising a base comprising a plurality of sample wells; a covering made from pierceable material; a housing unit comprising a plurality of housing wells providing a predetermined fit in the plurality of sample wells; and an air-penetrable seal is provided herein.

The bottom of each sample well and each housing well of the multi-chambered microtiter plate of the invention may be clear or substantially clear.

The side walls of each sample well within the base of the multi-chambered microtiter plate of the invention may be vertical or substantially vertical.

The side walls of each housing well within the housing unit of the multi-chambered microtiter plate of the invention may be concave. The bottom of each housing well within the housing unit is open and designed to fit the top of each corresponding sample well within the base of the microtiter plate.

The covering made from pierceable material provides the base of each housing well within the housing unit.

The edges surrounding each sample well within the base of the microtiter plate may be raised to be flush with the edges surrounding each side of the base of the microtiter plate to provide an adequate seal between each sample well and its corresponding housing well.

BRIEF DESCRIPTION OF THE DRAWINGS

For a further understanding of the nature, objects, and advantages of the present disclosure, reference should be had to the following detailed description, read in conjunction with the following drawings, wherein like reference numerals denote like elements.

FIG. 6A is a photograph of the base (100) of the microtiter plate (10) on day 0 after sealing. FIG. 6B is a photograph of the base (100) of the microtiter plate (10) on day 7 after sealing. The water level in each well is indicated by the line within the well.

DETAILED DESCRIPTION

Before the subject disclosure is further described, it is to be understood that the disclosure is not limited to the particular embodiments of the disclosure described below, as variations of the particular embodiments may be made and still fall within the scope of the appended claims. It is also to be understood that the terminology employed is for the purpose of describing particular embodiments, and is not intended to be limiting. Instead, the scope of the present disclosure will be established by the appended claims.

In this specification and the appended claims, the singular forms "a," "an," and "the" include plural reference unless the context clearly dictates otherwise. Unless defined otherwise, all technical and scientific terms used herein have the same meaning as commonly understood to one of ordinary skill in the art to which this disclosure belongs.

The subject disclosure features, in one aspect, a multi-chambered microtiter plate (10) designed for high-throughput screening of piercing-sucking insects or arthropodsexposed to various compounds. In some embodiments, the multi-chambered microtiter plate (10) is a standard sized microtiter plate (about 8 cm×12 cm). For example, the multi-chambered microtiter plate (10) of the invention is designed for use in standard robotic and/or other automated systems, such as an imaging system.

The multi-chambered microtiter plate (10) of the invention may be manufactured using any suitable material. In some embodiments, the multi-chambered microtiter plate (10) of the invention is made of polystyrene, polypropylene, polycarbonate, and/or glass. In some embodiments, the microtiter plate (10) of the invention is made of a material suitable for imaging and/or optical detection.

Figure 1A:
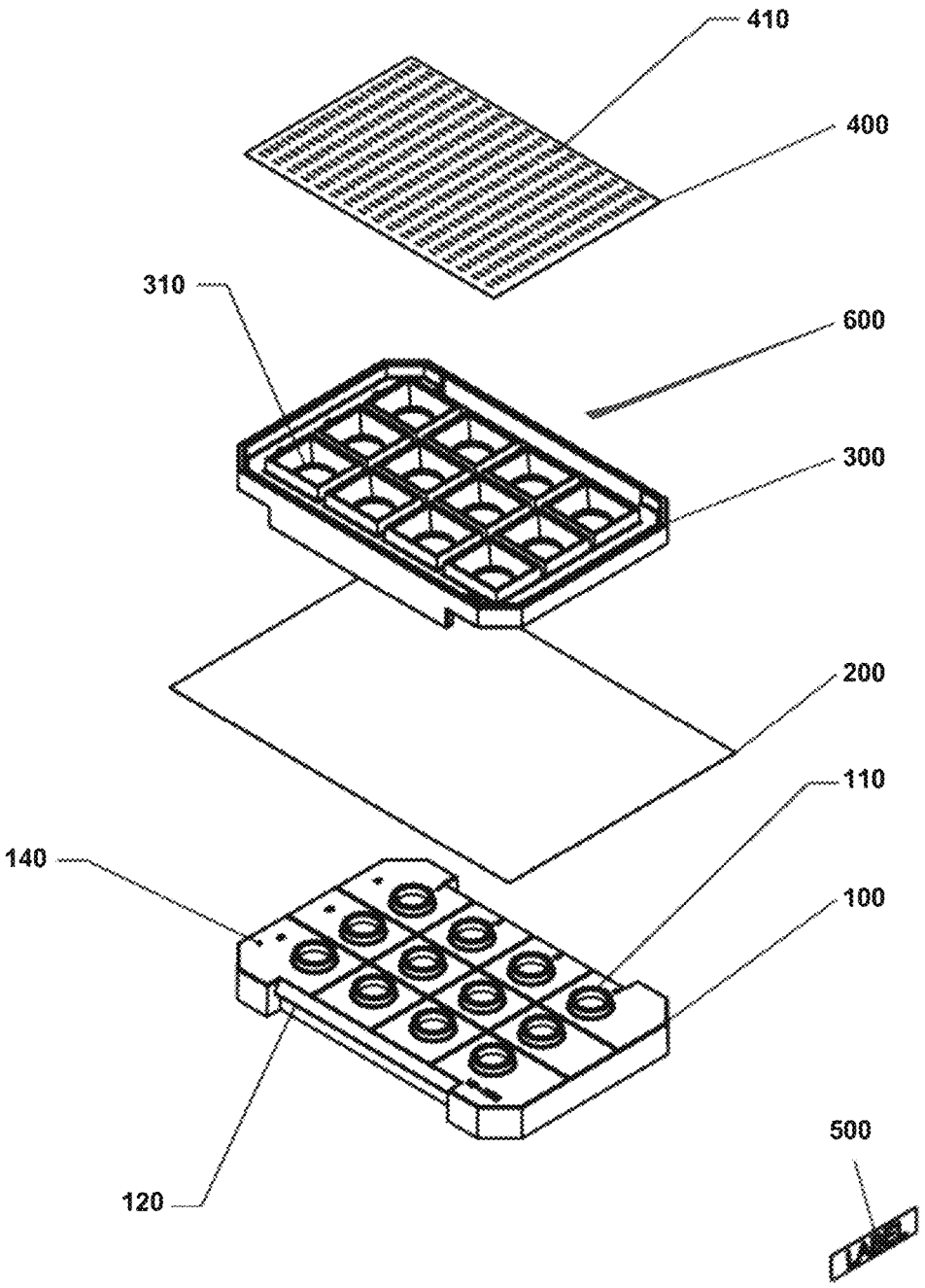
FIG. 1A-B show an expanded view (A) and assembled view (B) of an exemplary microtiter plate (10) of the invention comprising a base (100), a pierceable covering (200), an insect housing unit (300), a sealant (400), and, optionally, a label (500).
Figure 1B:
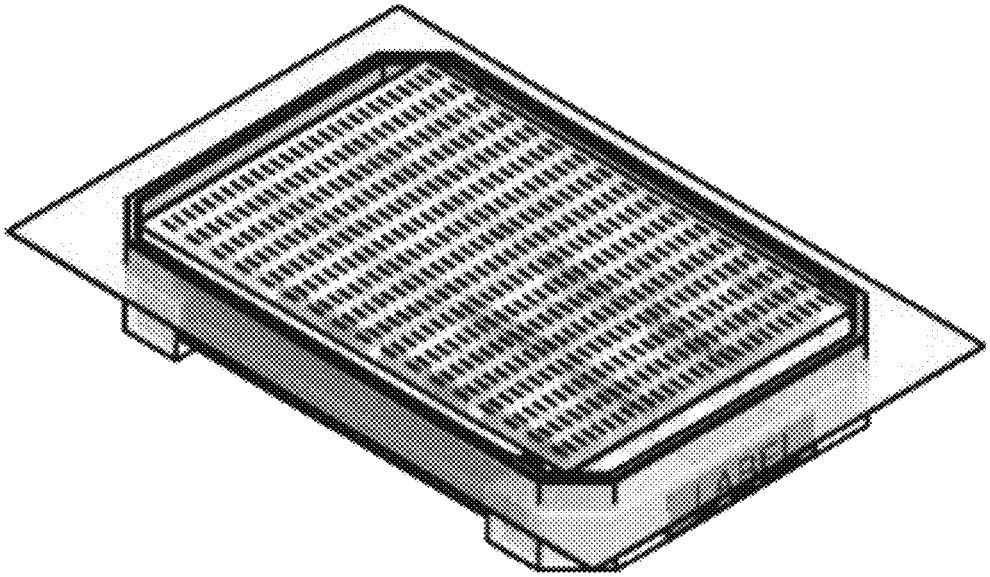

As illustrated in FIG. 1A-B, in one embodiment of the invention, the multi-chambered microtiter plate (10) comprises: a base (100), a pierceable covering (200), an insect housing unit (300), a seal (400), and, optionally, a label (500). In some embodiments, the multi-chambered microtiter plate (10) consists of: a base (100), a pierceable covering (200), a housing unit (300), a seal (400), and, optionally, a label (500).

The base (100) of the microtiter plate comprises multiple sample wells (110). In some embodiments, each sample well (110) has raised edges to ensure adequate sealing of each well and to preserve labelling of each column, row, and/or well. In some embodiments, each sample well (110) is flat bottomed. In some embodiments, the side wall(s) of each sample well (110) is vertical or substantially vertical. It should be understood that the sample wells (110) can be any shape suitable for its purpose of containing liquid and allowing imaging of the microtiter plate (10) using any suitable imaging system.

In some embodiments, the base (100) comprises grooves (130) surrounding each sample well (110) to prevent cross-contamination between sample wells if, for example, the pierceable covering (200) of an individual sample well (110) leaks or breaks.

Figure 2A:
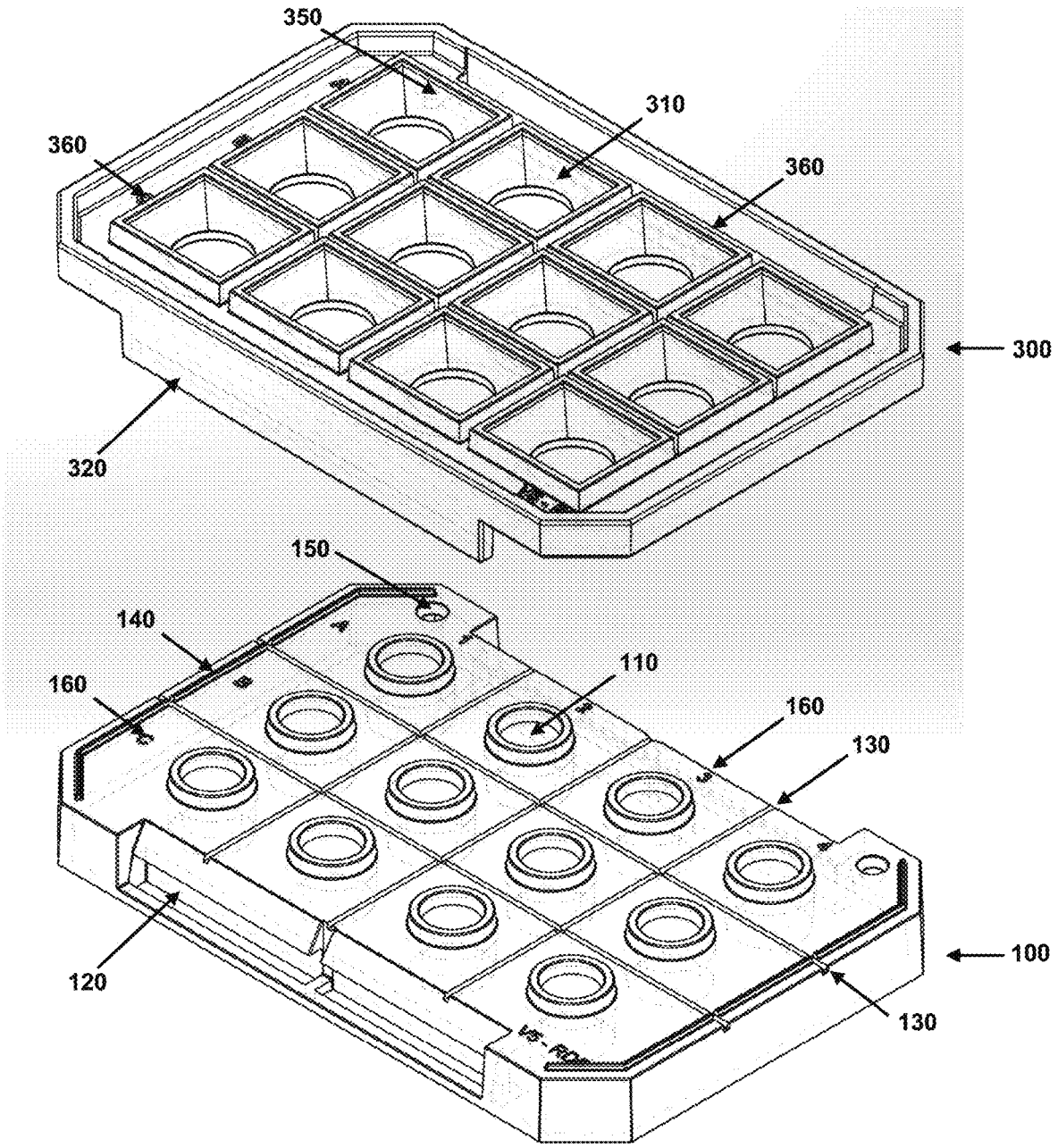
FIG. 2A-C shows a detailed rendering of a base (100) and insect housing unit (300) of an exemplary microtiter plate (10) of the invention.
Figure 2B:
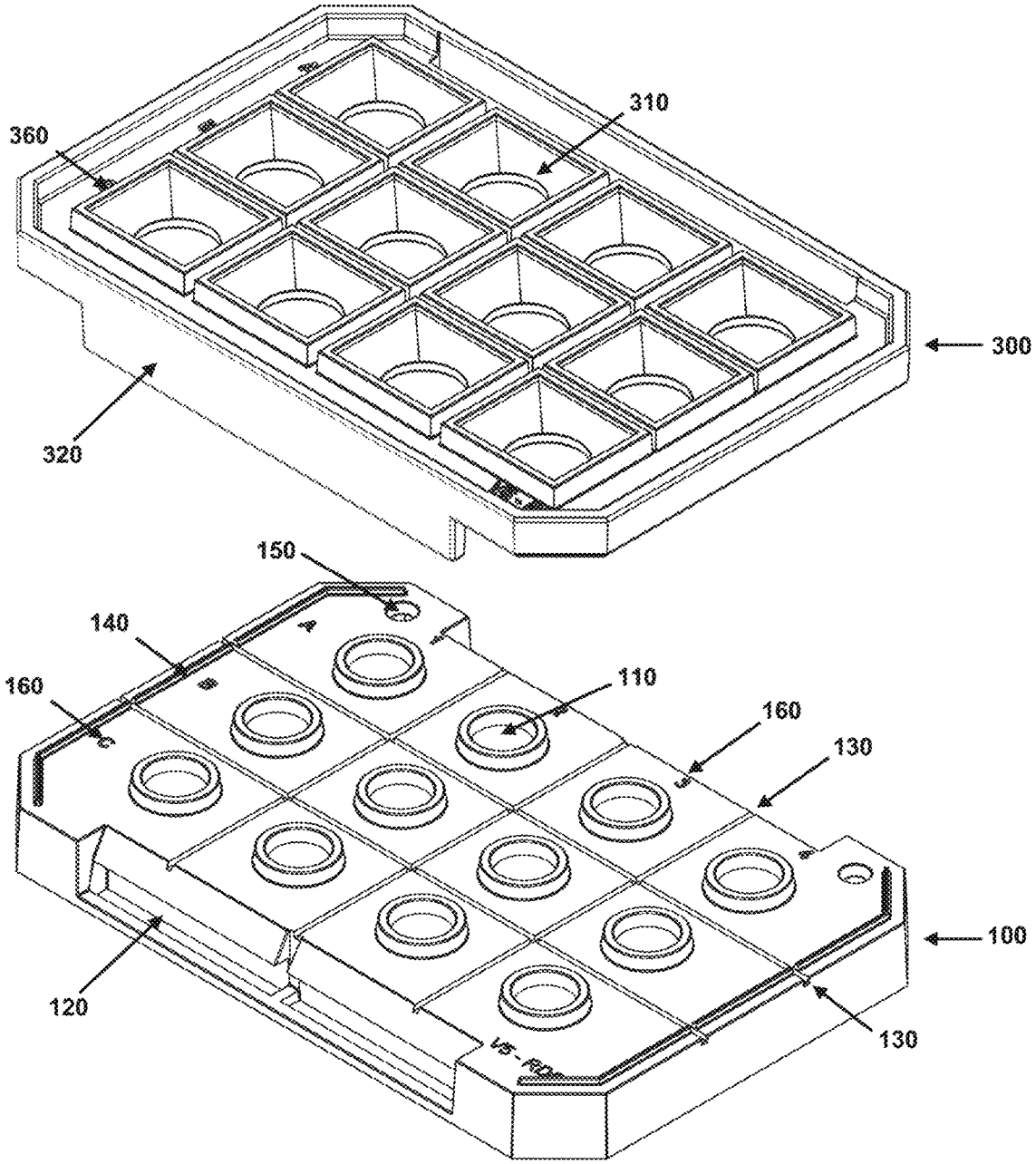
Figure 2C:
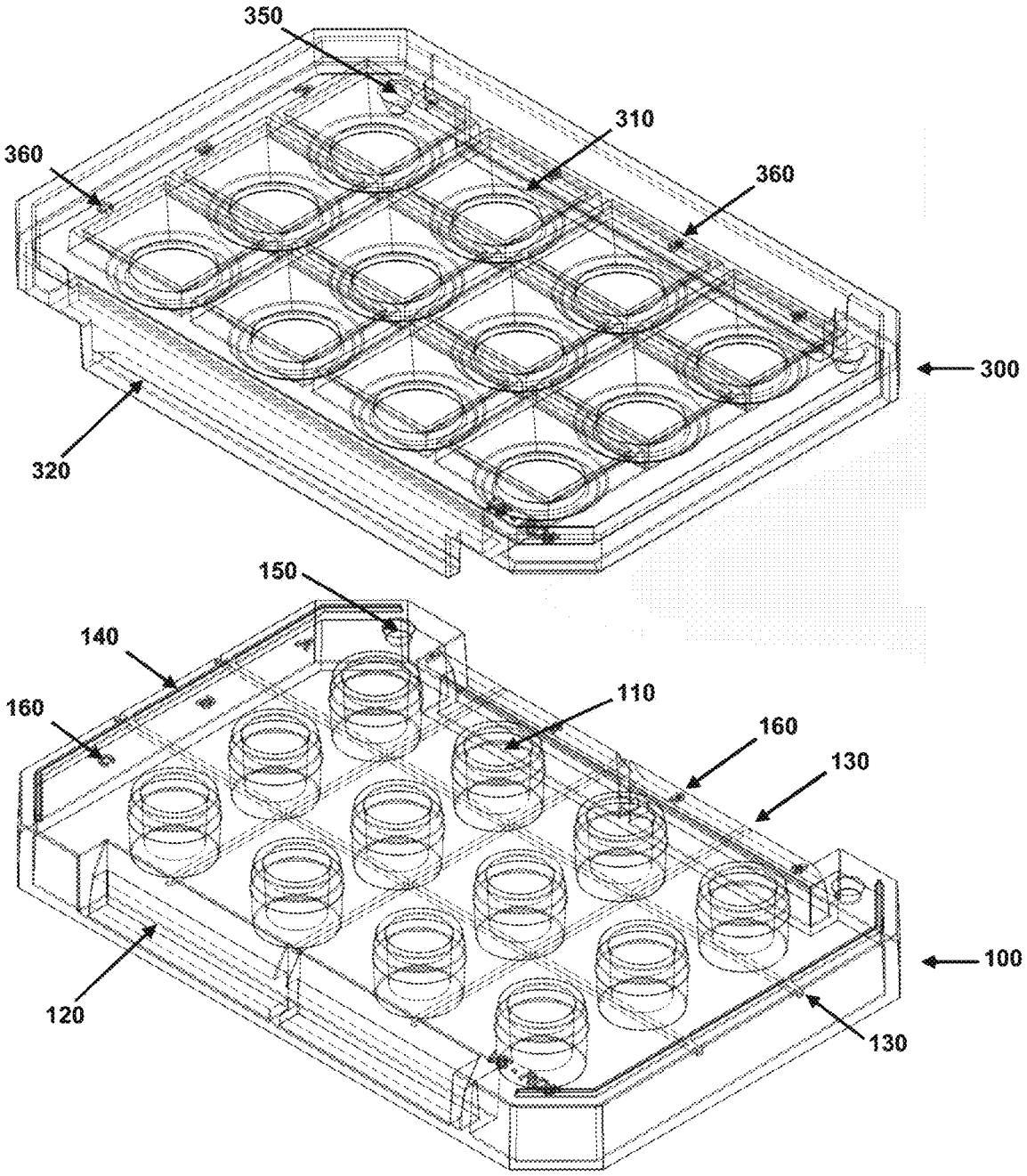
Figure 3:
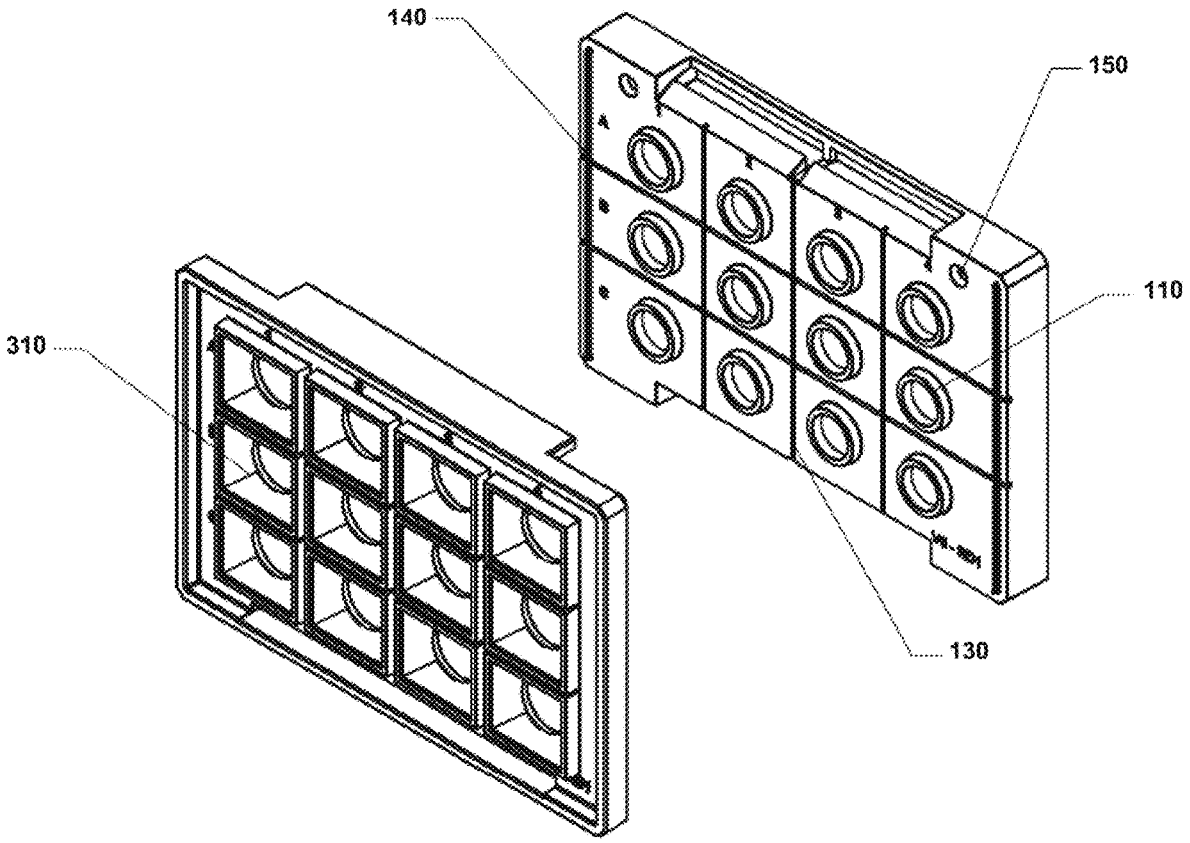
FIG. 3 shows a detailed rendering of a base (100) and insect housing unit (300) of an exemplary microtiter plate (10) of the invention.

In some embodiments, the base (100) comprises means to attach the insect housing unit (300) to the base (100). The means to attach and/or separate the insect housing unit (300) to the base (100) may be manual, automated, or both. In some embodiments, the means may be a latching mechanism (120) on one or more sides of the base (100) designed to interlock with a ridge (320) on the corresponding side(s) of the insect housing unit (300). As illustrated in FIG. 2A-C, the latching mechanism may have a compressible arrowhead-style design. In another embodiment, the means to attach the insect housing unit (300) to the base (100) may be between each sample well (110) and its corresponding housing well (310).

In some embodiments, the base (100) comprises a raised border (140) on one or more sides of the base (100). The raised border(s) (140) may function to ensure an adequate seal between the base (100) and the insect housing unit (300). The raised border(s) (140) may also function to cut the pierceable covering (200), allowing for removal of excess pierceable covering (200) and/or ease of plate incubation. The raised border(s) (140) may also function to facilitate stacking of multiple bases (100).

In some embodiments, the base (100) and/or the insect housing unit (300) are labelled (160 and 360, respectively) to allow identification of each sample well (110) and/or housing well (310). Optionally, the base (100) and/or the insect housing unit (300) comprise alphanumeric labels to allow identification of each sample well (110) and/or housing well (310).

In some embodiments, the base (100) and insect housing unit (300) are designed such that they are incompatible if one attempts to place them together in the wrong orientation (i.e., if the sample wells are not aligned with their corresponding housing wells). In some embodiments, the base (100) comprises one or more holes (150) of predetermined size, shape and location and the insect housing unit (300) comprises corresponding pegs (350) designed to fit into the one or more holes only if both components (i.e., base (100) and insect housing unit (300)) are in the correct orientation.

In some embodiments, the latching mechanism is designed such that the base (100) and the insect housing unit (300) may be separated after the two units have been attached.

While certain mechanisms for attaching the insect housing unit (300) to the base (100) are contemplated above, it should be understood that the invention encompasses any mechanism that provides an adequate seal between each sample well (110) and its corresponding housing well (310) for the duration of its use.

The pierceable covering (200) can be any material that a piercing-sucking insect or arthropod can penetrate using its mouthpiece or feeding anatomy. In some embodiments, the pierceable covering is a film, membrane, and/or tape made from a material such as, for example, cellulose, polyurethane, polyethylene, polyolefin, vinyl, or silicone. Examples of pierceable coverings of the invention include, but are not limited to, Breathe-Easy® sealing membrane, Titer Tops® sealing film, VWR® Polyolefin films, VWR® PCR films, polyethylene; VWR® Precut Pierceable vinyl films for robotics, and VWR® thin polyester films for ELISA and general incubation. In one embodiment, the pierceable covering (200) is a non-adhesive stretch film, such as Parafilm®.

The housing unit (300) of the microtiter plate comprises multiple housing wells (310) designed to be compatible with the corresponding sample well (110) of the base (100). It should be understood that the housing wells (310) can be any shape suitable for its purpose of housing insects and allowing imaging of the microtiter plate (10). In some embodiments, each housing well (310) has raised edges to ensure adequate sealing of each well and to preserve labelling of each column, row, and/or well.

As illustrated in FIG. 2A-C, in some embodiments, the side walls of each housing well (310) within the housing unit (300) of the multi-chambered microtiter plate of the invention (10) may be concave (i.e., tapered such that the top of each housing well is wider than the bottom of each housing well). It was found that a concave configuration within each housing well (310) allowed optimal imaging of insects contained within the housing wells (310).

The bottom of each housing well (310) within the housing unit (300) is open and designed to fit the top of each corresponding sample well (110) within the base (100) of the microtiter plate (10). This configuration allows the pierceable covering (200) to separate the insects within the housing well(s) (310) from the liquid diet within the sample well(s) (110).

As described above, in some embodiments, the housing unit (300) comprises means (e.g., a latching mechanism (320)) to connect the housing unit (300) onto the base (100).

Also, as described above, in some embodiments, the housing unit (300) is designed such that it is incompatible with the base (100) if one attempts to place them together in the wrong orientation. In some embodiments, the insect housing unit (300) comprises one or more pegs (350) designed to fit into one or more holes (150) of the base (100) only if both components (i.e., base (100) and insect housing unit (300)) are in the correct orientation.

Figure 4A:
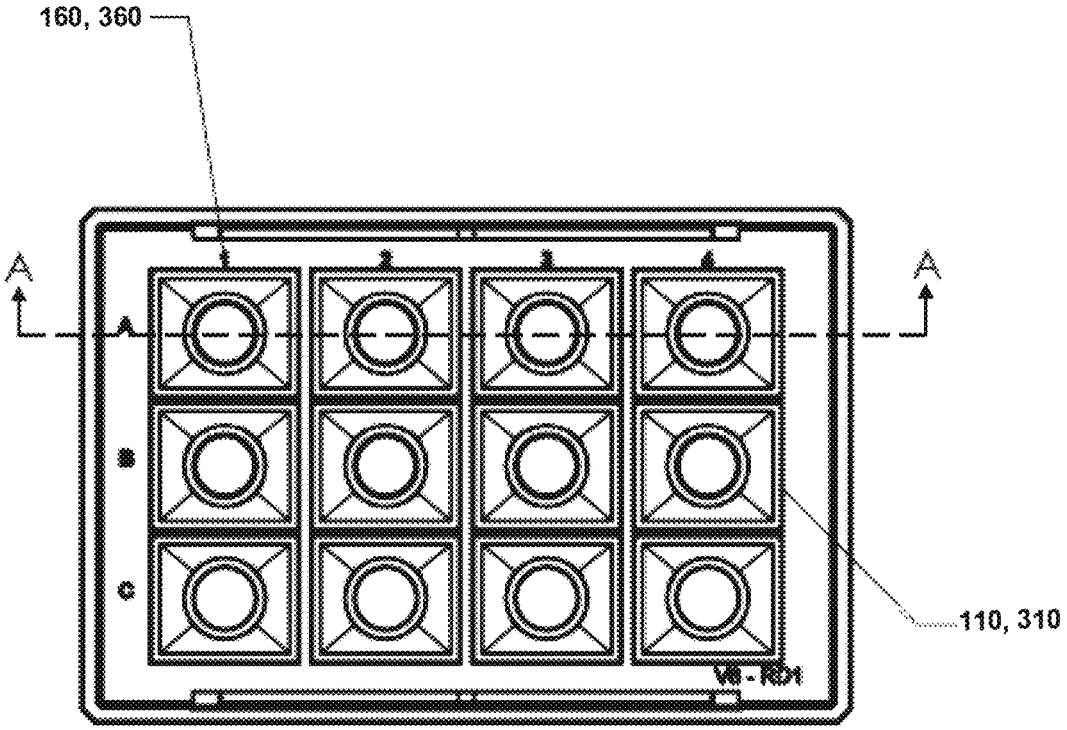
FIG. 4A-B shows a detailed rendering of an assembled base (100) and insect housing unit (300) of an exemplary microtiter plate (10) of the invention in top view (A) and in cross-section (B). The cross-section is taken from the dashed line in FIG. 4A labelled "A-A". Detail E in FIG. 4B shows a cutting mechanism (370) provided by the insect housing unit (300) designed to remove excess pierceable covering (e.g., Parafilm) (200). Detail B in FIG. 4B shows the seal between the base (100) and the insect housing unit (300) provided by the pierceable covering (200).
Figure 4B:
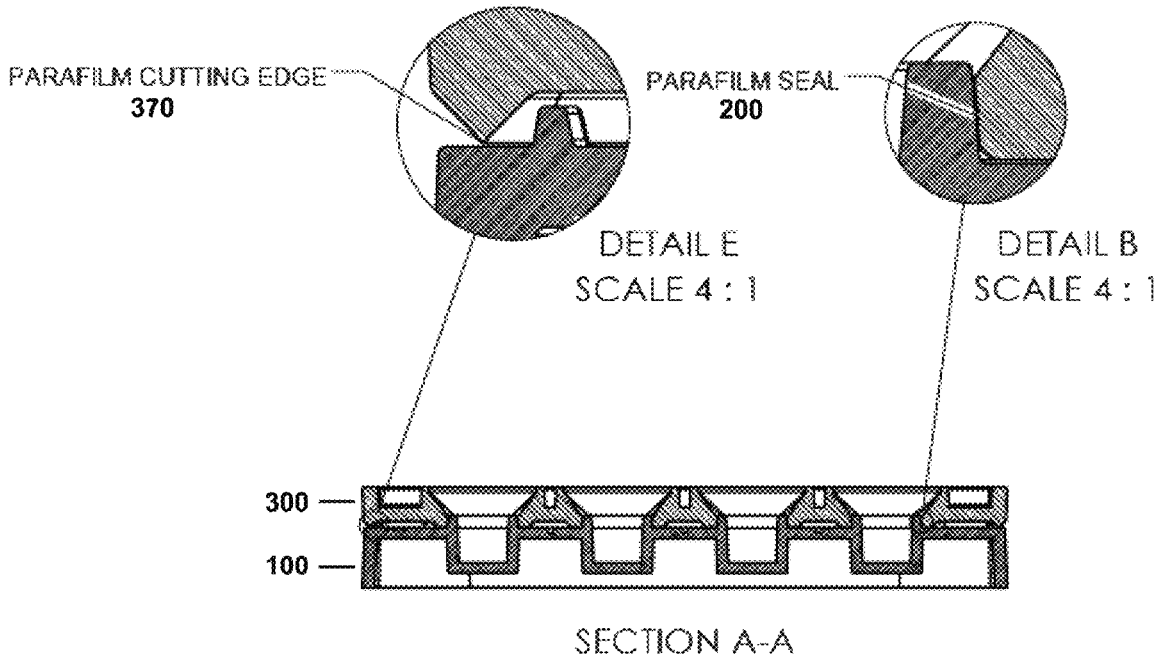
Figure 5:
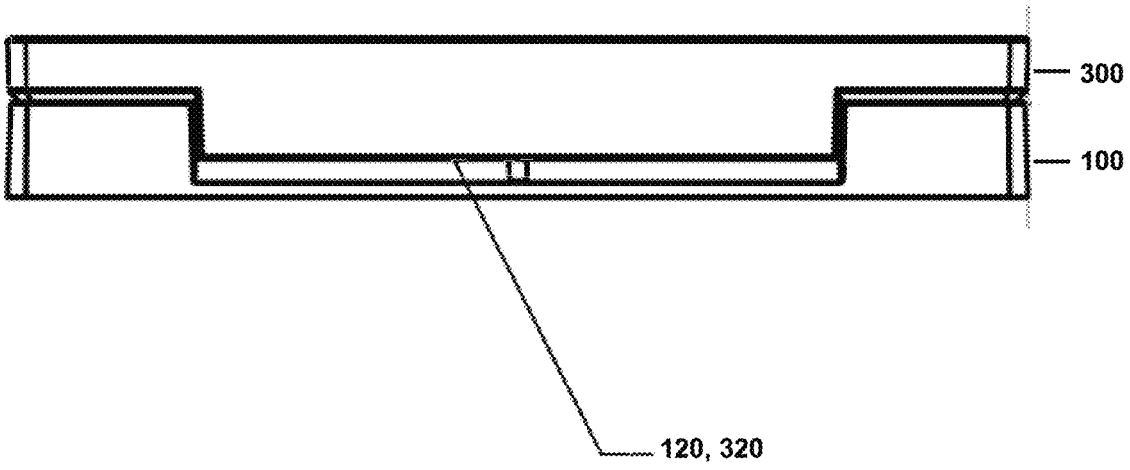
FIG. 5 shows a side view rendering of an assembled base (100) and insect housing unit (300) of an exemplary microtiter plate (10) of the invention.

Also, as described above, in some embodiments, the housing unit (300) comprises means to cut and/or remove excess pierceable covering (200) upon attachment of the base (100) and the housing unit (300). As illustrated in FIG. 4B, in some embodiments, this means may comprise a pointed ridge (370) on the bottom side of one or more edges of the housing unit (300). In some embodiments, this means may consist of a pointed ridge (370) on the bottom side of one or more edges of the housing unit (300).

The seal (400) can be any material that provides an adequate seal around each well of the housing unit (300) and is permeable to air and/or can be modified to be permeable to air. In some embodiments, the seal (400) comprises perforated holes (410). In some embodiments, an automatic sealer is used to apply the seal (400) to the insect housing unit (300).

The microtiter plates (10) of the invention can be used to perform feeding assays on piercing-sucking arthropods,such as insects, for example, to screen compounds for toxicity. In some embodiments, compounds to be tested and/or liquid feed solutions are pipetted into the sample well(s) within the base (100). The pierceable covering (200) is then placed on top of the base (100). Next, the insect housing unit (300) is placed on top of the covered base (100, 200). The insects to be tested (600) are placed into the housing wells of the housing unit (300) of the microtiter plate. The seal (400) is then placed on top of the insect housing unit (300) of the microtiter plate and sealed using any appropriate means.

The bottom of each component (100, 200, 300, 400) of the microtiter plate of the invention (10) may be comprised of a substantially clear or clear material to allow for optimal imaging. In other words, at least the bottom of each component (100, 200, 300, 400) of the microtiter plate of the invention (10) may be transparent or substantially transparent.

A 12-well microtiter plate of the invention (10) is exemplified herein. However, it will be clear to one of skill in the art that the microtiter plate of the invention (10) may comprise fewer than 12 wells or more than 12 wells to accommodate different insects or uses. Thus, in some embodiments, the microtiter plate of the invention (10) may be a 6-well, 8-well, 24-well, 48-well, 96-well, or 384-well microtiter plate. In some embodiments, the distance between each well in the microtiter plate of the invention (10) is typical of standard multi-chambered (i.e., multi-well) microtiter plates.

It should be understood that each chamber within the microtiter plate of the invention (10) comprises a sample well (110) and a housing well (310) separated by the pierceable covering (200).

The microtiter plate of the invention (10) is primarily contemplated for use in a laboratory setting and/or within a controlled environment; i.e., an incubator. However, the microtiter plate of the invention (10) could be used in any environment relevant to the assay and/or experiment for which it is being used. For example, the microtiter plate of the invention (10) may be used and/or stored in a wide range of temperatures (e.g., freezer, refrigerator, heated incubator). Additionally, the microtiter plate of the invention (10) may be exposed to high temperatures during heat sealing of the seal (400). Thus, in some embodiments, the base (100) and/or insect housing unit (300) of the microtiter plate of the invention (10) is made from one or more materials, such as, but not limited to, polystyrene, polypropylene, and polycarbonate.

The microtiter plate of the invention (10) can be used with any piercing-sucking arthropod, such as an insect. In some embodiments, the piercing-sucking arthropod can be any insect belonging to the orders Hemiptera, Siphonaptera, Phthiraptera, Thysanoptera, Diptera, Trombidiformes, and/or Parasitiformes.

Examples of piercing-sucking arthropods include, but are not limited to, beneficial and pest arthropods. Examples include but are not limited to crop pests such as aphids, leafhoppers, stink bugs, tarnished plant bugs, squash bugs, thrips, spider mites, lace bugs, mealy bugs, crape myrtle bark scale, and box elder bugs. Examples of beneficial arthropods include, but are not limited to, assassin bugs, predatory stink bugs, and insidious flower bugs. ther examples of piercing-sucking arthropods include, but are not limited to,animal pests such as mosquitoes, bed bugs, ticks, lice, and blackflies.

Piercing-sucking arthropods, such as insects, according to the invention include, but are not limited to, any insect in the families: Pentatomidae (e.g., stink bugs), Acanthosomatidae (e.g., shield bugs), Aphididae (e.g., aphids), Cicadidae (e.g., cicadas), Cicadellidae (e.g., leafhoppers), Membracidae (e.g., treehoppers), Miridae (e.g., plant bugs, leaf bugs, grass bugs), Aleyrodidae (e.g., whiteflies), Diaspididae (e.g., armoured scales), Dactylopiidae (e.g., cochineal insects), Coccidae (e.g., soft scales), Pseudococcidae (e.g., mealybugs), Adelgidae (e.g., adelgids), Lygaeoidea (e.g., seed bugs), Blissidae (e.g., chinch bugs), Cimicidae (e.g., bedbugs), Psyllidae (e.g., psyllids), Culicidae (e.g., mosquitoes), Ceratopogonidae (e.g., biting midges), Cecidomyiidae (e.g., gall midges), Psychodidae (e.g., sand flies), Tetranychidae (e.g., spider mites), Eriophyidae (e.g., gall mites), Ixodidae (e.g., hard ticks), and/or Argasidae (e.g., soft ticks).

In some embodiments, the piercing-sucking insect or arthropod is selected from plant bugs in the Miridae family such as, for example, western tarnished plant bugs (Lygus hesperus species), tarnished plant bugs (*Lygus lineolaris* species), and pale legume bugs (Lygus elisus) and stink bugs (Pentatomidae family species).

In some embodiments, the piercing-sucking insect or arthropod is a stink bug. Examples of stink bugs include, but are not limited to, *Halyomorpha halys* (brown marmorated stink bug), *Chinavia hilaris* (green stink bug), *Alcaeorrhynchus grandis, Cosmopepia lintneriana* (twice-stabbed stink bug), *Oebalus pugnax* (rice stink bug), and *Euthyrhynchus floridanus* (Florida predatory stink bug).

EXAMPLES

Example 1

Seal Testing.

The base (100) of a 12-well microtiter plate according to the invention (10) was filled with approximately 0.5 mL water and sealed with a Parafilm sheet (200).

The level of the water in each well was monitored daily to determine the quality of the seal for one week.

Figure 6A:
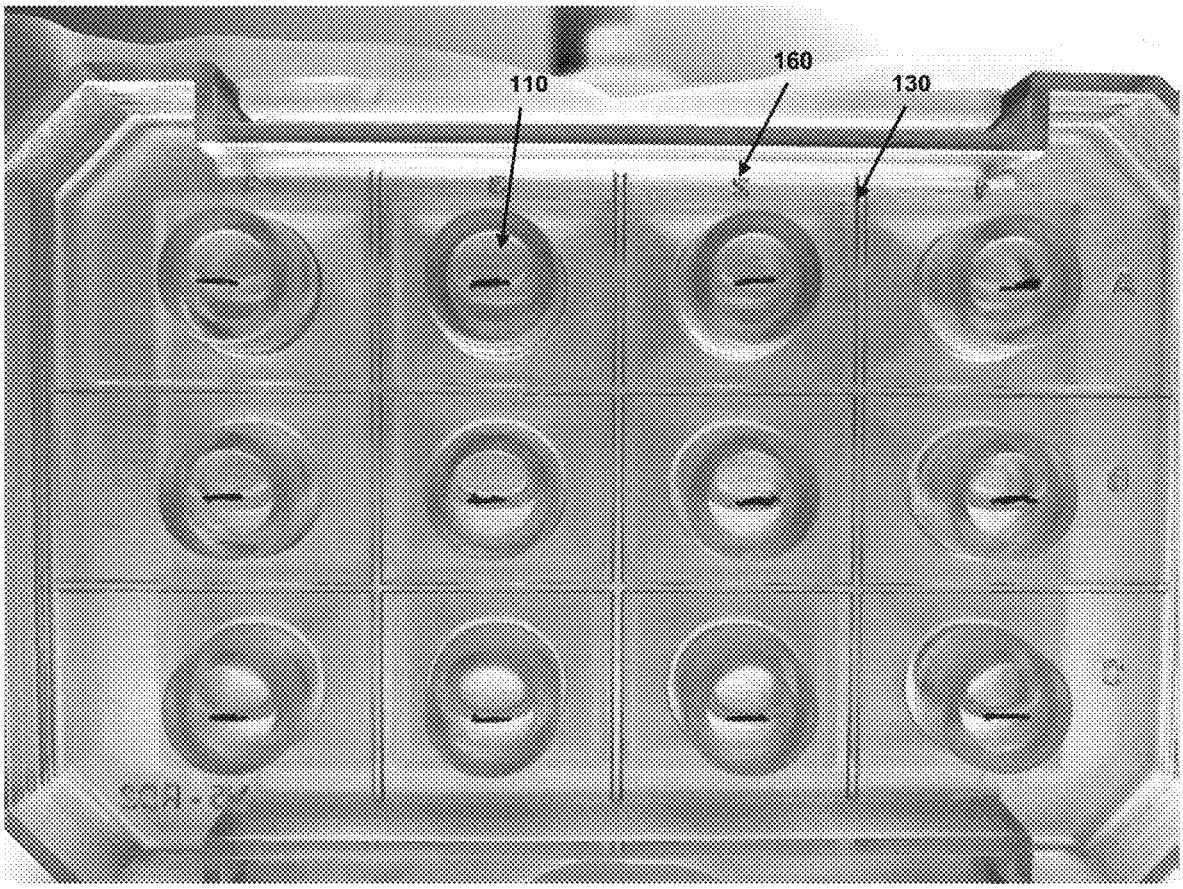
FIG. 6A-B shows the results of seal testing of the microtiter plates of the invention.
Figure 6B:
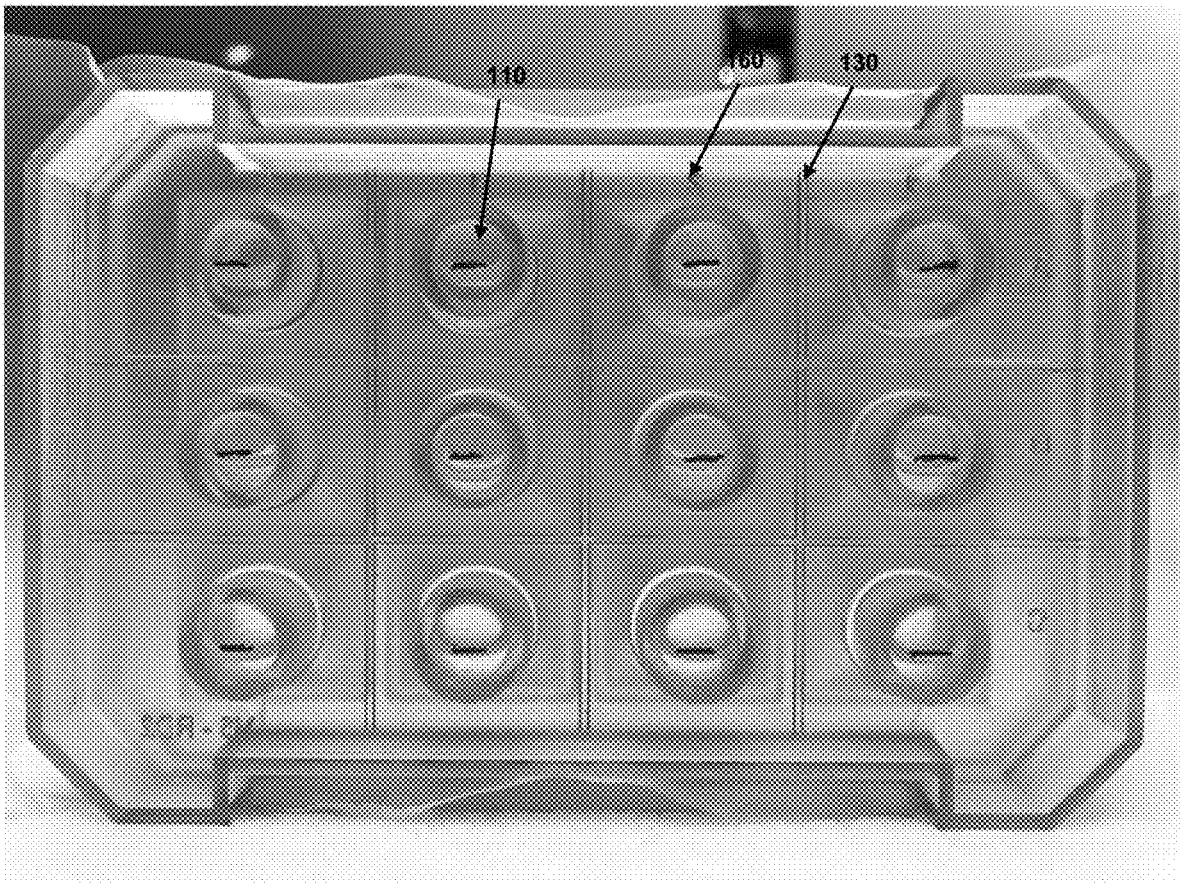

As shown in FIG. 6A-B, the water level within each well (indicated by black lines) was not significantly decreased up to one week after sealing. No leakage from the wells was observed; it can be assumed that any water loss was due to evaporation through the Parafilm membrane. This confirms that the microtiter plate wells are sufficiently sealed for at least one week after sealing.

Example 2

In vitro feeding assay.

Each sample well (110) within the base (100) of ten 12-well 3D printed microplates of the invention (10) were filled with 300 μL insect diet/well and Parafilm sheets (200) were placed on top of the bases (100).

An insect housing unit (300) was snapped onto each base (100) to create a Parafilm seal between the liquid diet in the sample wells (110) of the base (100) and the insect housing unit (300).

An excess of Pentatomidae nymphs of the same age were collected and rendered inert for several minutes with exposure to cold temperatures or carbon dioxide gas. Inert insects were added to the housing wells (310) of the insect housing unit (300) and placed in an automated sealer to apply perforated seals (400) to top of plate wells.

The sealed plates (10) were then placed on their side in an incubator at ideal rearing conditions for 7 days. A control of an established Pentatomidae assay was set up simultaneously with the same cohort of insects that underwent the same temperature/carbon dioxide treatments.

After one week, mortality and development were quantified visually and compared between cold-exposed and carbon dioxide exposed nymphs, and between the established assay and the plate assay.

The data yielded no significant insect health differences were found between any treatments.

All references cited in this specification are herein incorporated by reference as though each reference was specifically and individually indicated to be incorporated by reference. The citation of any reference is for its disclosure prior to the filing date and should not be construed as an admission that the present disclosure is not entitled to antedate such reference by virtue of prior invention.

It will be understood that each of the elements described above, or two or more together may also find a useful application in other types of methods differing from the type described above. Without further analysis, the foregoing will so fully reveal the gist of the present disclosure that others can, by applying current knowledge, readily adapt it for various applications without omitting features that, from the standpoint of prior art, fairly constitute essential characteristics of the generic or specific aspects of this disclosure set forth in the appended claims. The foregoing embodiments are presented by way of example only; the scope of the present disclosure is to be limited only by the following claims.

What is claimed is:

1. A method for containing, screening, and/or imaging piercing-sucking pests, comprising containing, screening, and/or imaging piercing-sucking pests in a multi-chambered microtiter plate, the method comprising:

providing the microtiter plate comprising:

a base comprising a plurality of sample wells;

a film that covers the base and is made from material that is pierceable by an insect's feeding anatomy;

an insect housing unit comprising a plurality of housing wells with a predetermined fit in the plurality of sample wells, wherein the bottom of each housing well is designed to fit the top of each corresponding sample well and allows an insect housed within a housing well to pierce the film covering the base to access a material in a corresponding sample well using the insect's feeding anatomy;

an air-penetrable seal configured to close-off the plurality of housing wells to contain insects in the housing wells, the method further comprising:

placing piercing-sucking pests into housing wells of the plate; and providing a liquid diet for the piercing-sucking pests in the sample wells of the plate.

2. The method of claim 1, further comprising screening and/or assaying the piercing-sucking pests.

3. The method of claim 1, wherein the piercing-sucking pests are arthropods.

4. The method of claim 2, wherein the piercing-sucking pests are arthropods.

* * * * *